US010215033B2

(12) United States Patent
Willett, Jr. et al.

(10) Patent No.: US 10,215,033 B2
(45) Date of Patent: Feb. 26, 2019

(54) STATOR SEAL FOR TURBINE RUB AVOIDANCE

(75) Inventors: Fred Thomas Willett, Jr., Burnt Hills, NY (US); Michael Earl Montgomery, Niskayuna, NY (US); Peter John Eisenzopf, Altamont, NY (US); Richard James Miller, Round Lake, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1091 days.

(21) Appl. No.: 13/449,657

(22) Filed: Apr. 18, 2012

(65) Prior Publication Data

US 2013/0280047 A1 Oct. 24, 2013

(51) Int. Cl.

| | |
|---|---|
| ***F01D 9/00*** | (2006.01) |
| ***F01D 5/20*** | (2006.01) |
| ***F01D 11/12*** | (2006.01) |
| ***F01D 11/18*** | (2006.01) |
| *B21D 53/84* | (2006.01) |

(52) U.S. Cl.

CPC ..... *F01D 5/20* (2013.01); *F01D 11/122* (2013.01); *F01D 11/18* (2013.01); *Y10T 29/49297* (2015.01)

(58) Field of Classification Search

CPC ..... F01D 11/08; F01D 11/12; F01D 11/122; F01D 11/125; F01D 11/127; F01D 11/14; F01D 5/20; F05D 2240/11

USPC ..... 415/9, 173.1, 173.4–173.5, 174.4–174.5, 415/196

See application file for complete search history.

(56) References Cited

U.S. PATENT DOCUMENTS

| | | | | |
|---|---|---|---|---|
| 4,652,209 | A * | 3/1987 | Buddenbohm | 415/174.4 |
| 4,662,821 | A | 5/1987 | Kervistin et al. | |
| 4,874,290 | A | 10/1989 | Cang et al. | |
| 5,048,183 | A | 9/1991 | Cang et al. | |
| 5,645,399 | A | 7/1997 | Angus | |
| 5,791,871 | A * | 8/1998 | Sech et al. | 415/173.1 |
| 5,899,660 | A * | 5/1999 | Dodd | 415/9 |
| 6,250,641 | B1 | 6/2001 | Dinc et al. | |
| 6,422,807 | B1 | 7/2002 | Leach et al. | |

(Continued)

FOREIGN PATENT DOCUMENTS

| | | |
|---|---|---|
| CN | 1427921 | 7/2003 |
| CN | 101089552 | 12/2007 |

(Continued)

OTHER PUBLICATIONS

Chinese Office Action dated Jun. 12, 2015 issued in Chinese Patent Application No. 201310134983.3 and English translation, 24 pp.

(Continued)

*Primary Examiner* — Justin D Seabe
*Assistant Examiner* — Alexander A White
(74) *Attorney, Agent, or Firm* — Nixon & Vanderhye P.C.

(57) ABSTRACT

A stator seal for a turbine assembly includes a seal base securable to a turbine stator and including an annular inner surface, and an abradable coating disposed on the annular inner surface. The abradable coating and the annular inner surface have a predefined cross-sectional profile including a transient operation section that facilitates axial expansion and a steady state operation section that facilitates a tighter clearance.

14 Claims, 3 Drawing Sheets

(56) References Cited

U.S. PATENT DOCUMENTS

| | | | | |
|---|---|---|---|---|
| 6,435,823 | B1 | 8/2002 | Schroder | |
| 6,438,837 | B1 | 8/2002 | Berry et al. | |
| 6,575,719 | B2 | 6/2003 | Manner et al. | |
| 6,626,635 | B1 | 9/2003 | Prowse et al. | |
| 6,651,314 | B2 | 11/2003 | Hopeck | |
| 6,682,812 | B2 | 1/2004 | Scheckenbach et al. | |
| 6,849,965 | B2 | 2/2005 | Le Nabour et al. | |
| 7,165,946 | B2 | 1/2007 | Nava et al. | |
| 7,246,996 | B2 | 7/2007 | Harris | |
| 7,255,929 | B2 | 8/2007 | Turnquist et al. | |
| 7,473,072 | B2 | 1/2009 | Malak et al. | |
| 7,510,370 | B2 | 3/2009 | Strangman et al. | |
| 7,528,598 | B2 | 5/2009 | Goldfine et al. | |
| 7,618,712 | B2 | 11/2009 | Sabol et al. | |
| 7,658,588 | B1 | 2/2010 | Schopf et al. | |
| 7,852,092 | B2 | 12/2010 | Andarawis et al. | |
| 8,100,640 | B2 * | 1/2012 | Strock | F01D 11/122 415/173.4 |
| 2004/0022625 | A1 * | 2/2004 | Care | 415/173.3 |
| 2007/0285110 | A1 * | 12/2007 | Nigmatulin et al. | 324/699 |
| 2011/0103940 | A1 * | 5/2011 | Duval et al. | 415/173.4 |
| 2011/0285090 | A1 * | 11/2011 | Zheng | 277/355 |

FOREIGN PATENT DOCUMENTS

| | | | | |
|---|---|---|---|---|
| CN | 101899995 | | 12/2010 | |
| DE | 2745130 | A1 * | 4/1979 | F01D 11/001 |
| EP | 1 707 749 | | 10/2006 | |
| EP | 2 317 079 | | 5/2011 | |
| EP | 2 388 440 | | 11/2011 | |
| EP | 2 410 134 | | 1/2012 | |
| GB | 2 313 161 | | 11/1997 | |

OTHER PUBLICATIONS

European Search Report dated Jul. 30, 2015 issued in European Patent Application No. 13162966.9, 8 pp.

* cited by examiner

STATOR SEAL FOR TURBINE RUB AVOIDANCE

BACKGROUND OF THE INVENTION

The invention relates to seal clearances in rotary machines and, more particularly, to a static seal for a turbine assembly providing for greater clearance during transient operation and tighter clearance during steady state operation.

Rotary machines include, but are not limited to, gas turbines and steam turbines. The moving part of the turbine is called a rotor, and the fixed, non-moving part, i.e., housings, casings etc. is called a stator. Usually, the rotor rotates within a stator assembly at very high speeds, powering a generator, which in turn produces electricity or power.

A steam turbine has a steam path that typically includes, in serial-flow relationship, a steam inlet, a turbine, and a steam outlet. A gas turbine has a gas path, which typically includes, in serial-flow relationship, an air intake (or inlet), a compressor, a combustor, a turbine, and a gas outlet (or exhaust nozzle). Gas or steam leakage, either out of the gas or steam path or into the gas or steam path, from an area of higher pressure to an area of lower pressure, is generally undesirable. For example, gas path leakage in the turbine or compressor area of a gas turbine, between the rotor of the turbine or compressor and the circumferentially surrounding turbine or compressor casing, will lower the efficiency of the gas turbine leading to increased fuel costs.

Tight radial clearances are important to achieving high efficiency. Turbine operation at off-design conditions often means that the rotor and stator interfere, causing the turbine to "rub." Clearances can be increased to avoid rubs, but with a loss of turbine performance.

Abradable coatings have been developed for use on stator seals. The presence of these coatings allows the rotor to interfere with the stator without permanent damage to the rotor seal teeth. Instead, the rotor rubs away part of the coating on the stator seal. Other turbines use abradable material, such as honeycomb metal, to achieve the same result.

Typically, when a turbine is shut down after some period of operation, a turning gear is used to keep the rotor turning slowly to prevent uneven cooling. On rare occasions, the rotor seal teeth will penetrate the stator seal coating (abradable coating) during or after the turbine shutdown. This can be due to the nature of turbine operation, thermal or other distortion of the turbine rotor and/or stator, or dimensional variation in the turbine components or any combination of these. If the penetration is deep enough and affects multiple seal teeth, friction between the rotor and stator can overwhelm the turning gear capability, and the rotor can become "locked up."

As metal temperatures approach ambient air temperature, the turbine will return to its as-designed cold shape, and the rotor will free itself from the stator. Unfortunately, this process can take several days. An outage of several days is unacceptable to the turbine operator due to the loss of revenue.

It would be desirable to modify the stator seal such that an extended outage can be avoided.

BRIEF DESCRIPTION OF THE INVENTION

In an exemplary embodiment, a stator seal for a turbine assembly includes a seal base securable to a turbine stator and including an annular inner surface, and an abradable coating disposed on the annular inner surface. The abradable coating and the annular inner surface have a predefined cross-sectional profile including a transient operation section that facilitates axial expansion and a steady state operation section that facilitates a tighter clearance.

In another exemplary embodiment, a stator seal for a turbine assembly includes a seal base securable to a turbine stator and including an annular inner surface, and an abradable coating disposed on the annular inner surface. The abradable coating and the annular inner surface have a predefined profile including one of:

the abradable coating having a tapered profile from a projected axial position of a seal tooth during transient operation toward a projected axial position of the seal tooth during steady state operation, the seal base having a seal land positioned adjacent the projected axial position of the seal tooth during steady state operation, and the abradable coating being disposed on the seal land, and the abradable coating having a higher density adjacent the projected axial position of the seal tooth during steady state operation than adjacent the projected axial position of the seal tooth during transient operation.

In still another exemplary embodiment, a method of making a stator seal for a turbine assembly includes the steps of providing a seal base securable to a turbine stator and including an annular inner surface; and disposing an abradable coating on the annular inner surface such that the abradable coating and the annular inner surface have a predefined profile including a transient operation section that facilitates axial expansion and a steady state operation section.

DETAILED DESCRIPTION OF THE INVENTION

Embodiments of the invention address the needs described above by providing a stator seal for a turbine assembly. The stator or static seal generally includes a seal base 12 securable to a turbine stator and including an annular inner surface. The seal base may be one or more of a shroud, a turbine casing, and an annular assembly of turbine nozzles. An abradable coating 14 is disposed on the annular inner surface of the seal base 12. Portions of the abradable coating 14 are removed in a predefined profile including a transient operation section 16 that facilitates axial expansion and a steady state operation section 18 that facilitates a tighter clearance.

Figure 1:
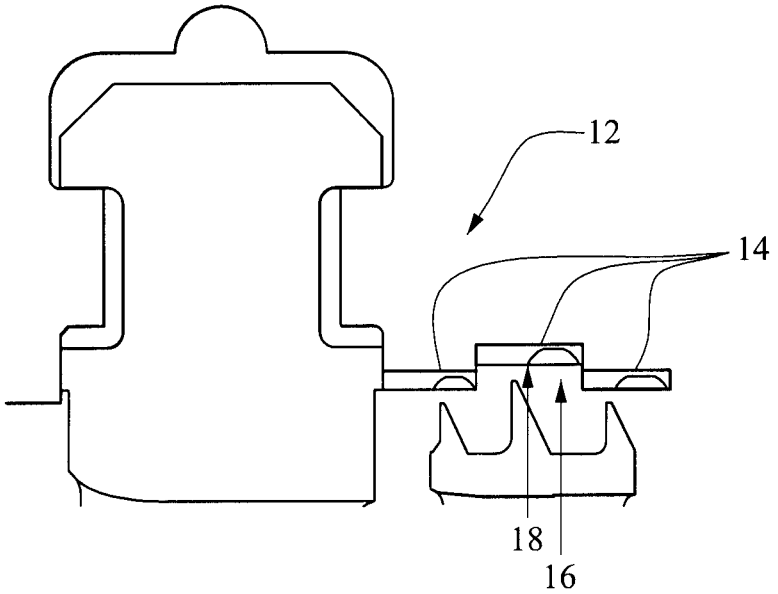
FIGS. 1 and 2 show a stator seal for a turbine assembly with an abradable coating cross-sectional profile in the shape of a polygon and being tapered, respectively.
Figure 2:
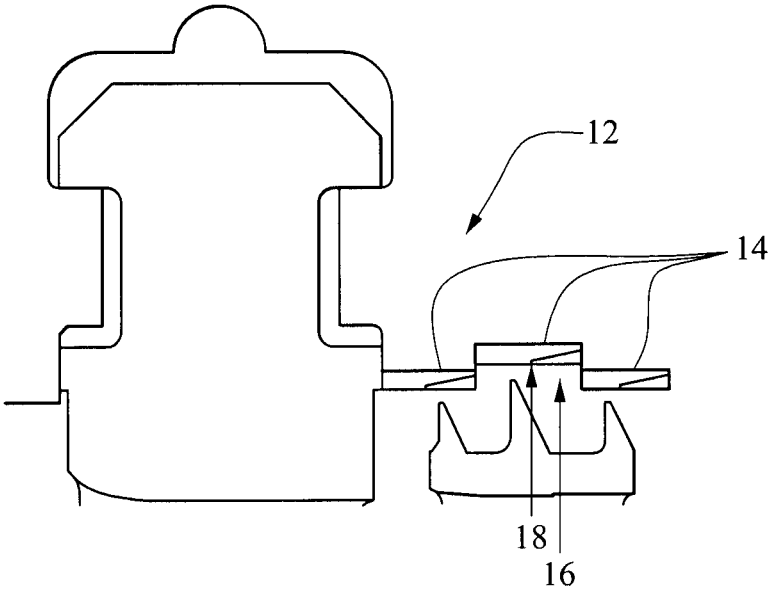

With reference to FIGS. 1 and 2, the predefined profile may include a tapered profile (FIG. 2) of the removed abradable coating from the transient operation section 16 with a first thickness to the steady state operation section 18 with a second thickness. In an exemplary embodiment, the first thickness is about 20 mils (0.020 inches), and the second thickness is about 100 mils (0.100 inches). Alternatively, the predefined profile may comprise the abradable coating removed in the shape of a polygon (FIG. 1). In this context, the abradable coating profile is altered so that the clearance is greater away from the axial steady state position of the seal, i.e., where the seal is more likely to rub. Although FIGS. 1 and 2 show two possible coating profiles, other shapes are possible. The increased clearance is shown at the right hand side of the static seal, though it could be applied on the left hand side as well. Clearance design calculations would determine the details of the coating profile based on the specific geometry of the turbine in question.

Post-coating machining of the seals could be done to create the tapered clearance profile. The profile could also be created by modifying the coating process, either by changing the speed of the spray gun or coating spray (flow) rate.

Figure 3:
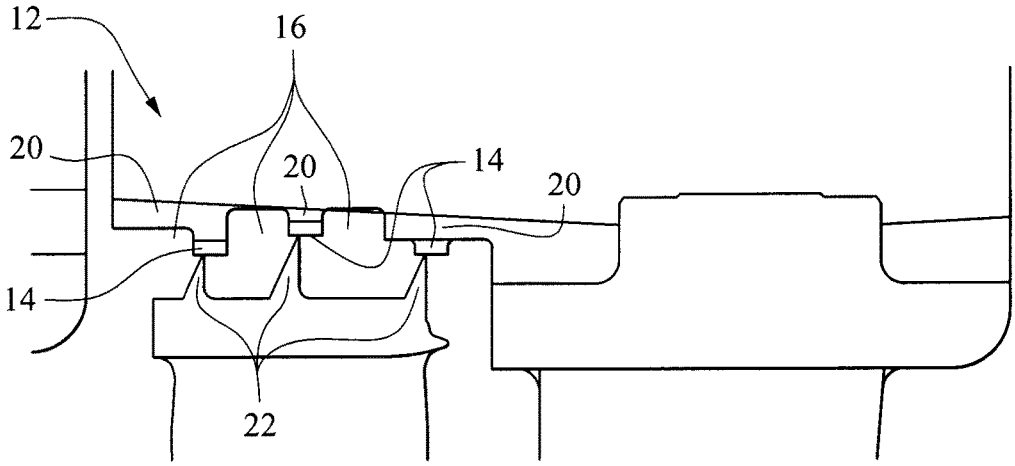
FIG. 3 shows an alternative embodiment utilizing a narrow seal land.

FIG. 3 shows an alternative solution. In FIG. 3, the seal base comprises at least one seal land 20 positioned adjacent a projected axial position of a corresponding number of rotating seal teeth 22 during steady state operation. The seal land 20 is a portion of the seal base that is radially inward as shown. In this context, the steady state operation section 18 includes the abradable coating 14 disposed on the at least one seal land 20. The transient operation section 16 includes areas in an axial direction on either side of the seal land(s) 20. Preferably, the seal base 12 comprises three seal lands 20 as shown positioned adjacent projected axial positions of a corresponding three rotating seal teeth 22 during steady state operation. The stator seal away from the land 20 is produced such that radial clearances are large during transient operation.

Another solution includes abradable seals used in conjunction with brush seals. In this case, the knife-edge seals are guard seals, and primary sealing is done by the brush seals. Eliminating abradable seal material and opening guard seal clearances reduces the risk of lock up, but increases leakage and performance loss.

As noted above, with existing static seals, there is a risk that once the seal teeth penetrate the abradable seal material, there may be relative axial motion, most likely due to differential thermal growth between the rotor and stator. As a consequence, the seal teeth are cutting into the abradable coating both radially and axially. The axial contact force, and hence the tangential friction force, is thus very high.

Figure 4:
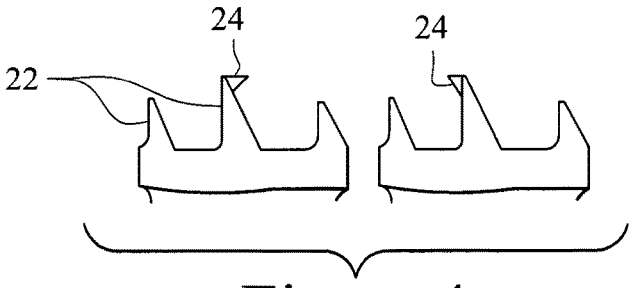
FIGS. 4 and 5 show cutting elements applied to the rotating seal teeth.
Figure 5:
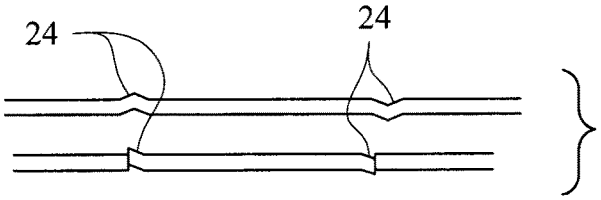

A solution to this problem may be to apply cutting elements 24 to the rotating seal teeth 22 as shown in FIG. 4 (exaggerated for clarity). Cutter teeth have been used extensively in gas turbine applications, both for power generation and aircraft propulsion. However, cutter teeth in these applications are used for both radial and axial cutting, not axial only as shown. The thin seal profile, both on bucket tips as shown and on the rotor in the form of J-seals, makes it possible to form a cutter tooth 24 simply by cold working the seal. FIG. 5 shows the top view of a bucket tip seal with a cutter tip 24 formed by cold working. A tooth 24 could be formed by dimpling the seal in the middle of the bucket, as shown in the top example, or by bending slightly the end of the seal on a bucket, as shown in the bottom example. Teeth 24 could be used on one or both sides of the seal. This approach is particularly advantageous for steam turbines, since the bucket tip seals are cut at final rotor machining, when the rotor is fully assembled.

Figure 6:
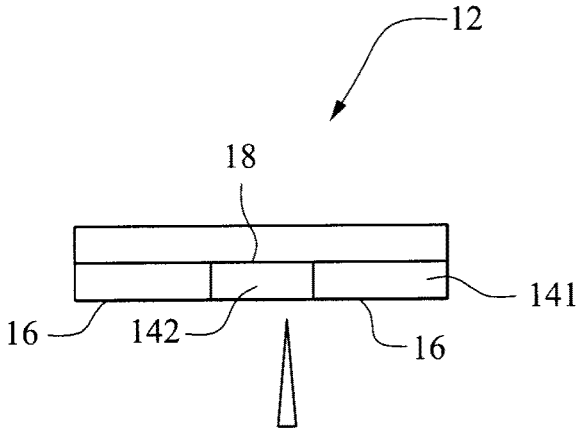
FIGS. 6-9 show an alternative static seal composition.
Figure 7:
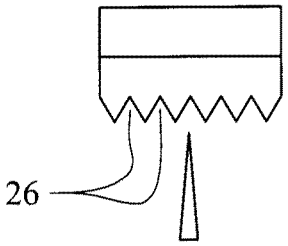
Figure 8:
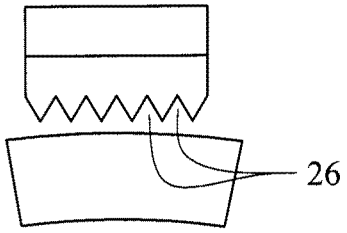
Figure 9:
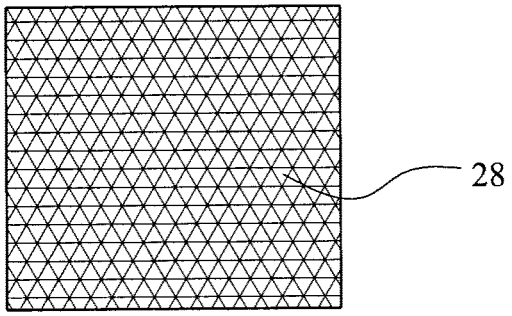

Another alternative is to make the seal material easier to cut, i.e., make it more abradable. In this context, with reference to FIG. 6, the transient operation section 16 may include an abradable coating 141 having a first density, and the steady state operation section 18 may have an abradable coating 142 having a second density higher than the first density. As such, in the regions where a rub is more likely to occur, the coating 141 is less dense. This can be accomplished by any number of means. One possibility is to increase the coating porosity in the specified region. With reference to FIGS. 7 and 8, another possibility is to use grooves 26 in the coating, oriented either circumferentially (FIG. 7) or axially (FIG. 8). The grooves 26 could be applied only in the rub region so that seal leakage is kept to a minimum. Yet another possibility is to create a knurled surface 28 in the specified region (FIG. 9). Knurling may not be a suitable process for creating such a surface, but non-conventional machining processes such as EDM or ECM could be used.

Turbine data show that steady state seal position is outside of or at the axial edge of rub boundaries. This suggests that increasing the radial clearance at the expected axial location of the rub will have no effect on turbine performance, as the clearance at steady state is not affected. With the structure of the preferred embodiments, the abradable coating profile is altered so that the clearance is greater away from the axial steady state position of the seal, i.e., where the seal is more likely to rub. The structure provides for a lower risk of seal rubs and of locking up during a seal rub. Additionally, the risk reduction does not come at the expense of performance or costs.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A stator seal for a turbine assembly, the stator seal comprising:

a seal base securable to a turbine stator and including an annular inner surface; and an abradable coating disposed on the annular inner surface, the abradable coating having a predefined cross-sectional profile including a transient operation section that facilitates axial expansion and a steady state operation section that facilitates a tighter clearance, the transient operation section and the steady state operation section being oriented in an axial direction to accommodate the axial expansion, wherein the transient operation section of the abradable coating is positioned adjacent a projected axial position of rotating seal teeth during transient operation and the steady state operation section of the abradable coating is positioned adjacent a projected axial position of the rotating seal teeth during steady state operation, and wherein the transient operation section is positioned on only one axial side of the steady state operation section for each of the rotating seal teeth.

2. The stator seal according to claim 1, wherein the predefined profile comprises a tapered profile of the abradable coating from the transient operation section with a first thickness to the steady state operation section with a second thickness.

3. The stator seal according to claim 2, wherein the first thickness is about 0.020 inches, and wherein the second thickness is about 0.100 inches.

4. The stator seal according to claim 1, wherein the predefined profile comprises the abradable coating in the shape of a polygon.

5. The stator seal according to claim 1, wherein the transient operation section comprises the abradable coating having a first density, and wherein the steady state operation section comprises the abradable coating having a second density higher than the first density.

6. The stator seal according to claim 5, wherein the abradable coating with the first density comprises grooves in the coating.

7. The stator seal according to claim 6, wherein the grooves are oriented circumferentially or axially.

8. The stator seal according to claim 5, wherein the abradable coating with the first density comprises a knurled surface.

9. The stator seal according to claim 5, wherein the abradable coating with the first density comprises an increased coating porosity.

10. The stator seal according to claim 1, wherein an axial length of the steady state operation section is greater than an axial length of the rotating seal teeth.

11. A stator seal for a turbine assembly, the stator seal comprising:

a seal base securable to a turbine stator and including an annular inner surface; and an abradable coating disposed on the annular inner surface, the abradable coating and the annular inner surface having a predefined cross-sectional profile including a transient operation section that facilitates axial expansion and a steady state operation section that facilitates a tighter clearance, the transient operation section and the steady state operation section being oriented in an axial direction to accommodate the axial expansion, wherein the transient operation section of the abradable coating is positioned adjacent a projected axial position of rotating seal teeth during transient operation and the steady state operation section of the abradable coating is positioned adjacent a projected axial position of the rotating seal teeth during steady state operation, and wherein the transient operation section is positioned on only one axial side of the steady state operation section for each of the rotating seal teeth, wherein the seal base comprises at least one seal land positioned adjacent the projected axial position of a corresponding number of the rotating seal teeth during steady state operation, wherein the steady state operation section includes the abradable coating disposed on the at least one seal land, and wherein the transient operation section comprises areas in axial directions on either side of the at least one seal land without the abradable coating and with transient radial clearances that are larger than steady state radial clearances during steady state operation.

12. The stator seal according to claim 11, wherein the seal base comprises three seal lands positioned adjacent projected axial positions of a corresponding three rotating seal teeth during steady state operation.

13. A stator seal for a turbine assembly, the stator seal comprising:

a seal base securable to a turbine stator and including an annular inner surface; and an abradable coating disposed on the annular inner surface, the abradable coating and the annular inner surface having a predefined profile including one of:

the abradable coating having a tapered profile from a projected axial position of a seal tooth during transient operation toward a projected axial position of the seal tooth during steady state operation, and the seal base having a seal land positioned adjacent the projected axial position of the seal tooth during steady state operation, and the abradable coating being disposed on the seal land, wherein the seal base further comprises areas in axial directions on either side of the seal land without the abradable coating and with transient radial clearances that are larger than steady state radial clearances during steady state operation, wherein the abradable coating is positioned adjacent the projected axial position of the seal tooth at least during steady state operation, wherein an axial length of the steady state operation section is greater than an axial length of the seal tooth, and wherein the transient operation section is positioned on only one axial side of the steady state operation section for each of the rotating seal teeth.

14. A method of making a stator seal for a turbine assembly, the method comprising:

providing a seal base securable to a turbine stator and including an annular inner surface; and disposing an abradable coating on the annular inner surface such that the abradable coating has a predefined profile including a transient operation section that facilitates axial expansion and a steady state operation section, wherein the disposing step comprises positioning the transient operation section of the abradable coating adjacent a projected axial position of rotating seal teeth during transient operation and positioning the steady state operation section of the abradable coating adjacent a projected axial position of the rotating seal teeth during steady state operation, and wherein the disposing step further comprises disposing the abradable coating such that an axial length of the steady state operation section is greater than an axial length of the rotating seal teeth.

* * * * *